US006112733A

United States Patent [19]

Wooten et al.

[11] Patent Number: 6,112,733

[45] Date of Patent: Sep. 5, 2000

[54] INTRUSION APPARATUS

[75] Inventors: Donald W. Wooten, Dallas; Thomas J. Pilling, Garland; Robert M. Wohlfeld, Dallas, all of Tex.

[73] Assignee: Tactical & Rescue Equipment, LLC, Plano, Tex.

[21] Appl. No.: 09/092,578

[22] Filed: Jun. 5, 1998

[51] Int. Cl.[7] ..... F41B 15/00; F41B 7/00; F41A 33/00; F41A 19/00

[52] U.S. Cl. ..... 124/26; 124/16; 124/27; 124/37

[58] Field of Search ..... 89/1.11, 1.2; 42/1.08; 124/16, 20.1, 21, 23.1, 26, 27, 29, 31, 37

[56] References Cited

U.S. PATENT DOCUMENTS

| | | | |
|---|---|---|---|
| 784,747 | 3/1905 | Lobit | 124/27 |
| 1,054,916 | 3/1913 | Gray | 124/26 |
| 1,070,039 | 8/1913 | Kennedy | 124/29 |
| 1,270,293 | 6/1918 | Hoexter et al. | 124/29 |
| 1,274,882 | 8/1918 | Hess | 124/29 |
| 1,506,068 | 8/1924 | Lange | 124/26 |
| 2,563,969 | 8/1951 | Skinner | 124/26 |
| 2,618,885 | 11/1952 | Tigrett | 124/27 |
| 2,650,593 | 9/1953 | Weil et al. | 124/27 |
| 2,719,716 | 10/1955 | Sawtelle | 124/16 |
| 2,735,221 | 2/1956 | Fields | 124/29 |
| 2,900,972 | 8/1959 | Marsh et al. | 124/31 |
| 2,939,449 | 6/1960 | Kortick | 124/27 |
| 2,955,586 | 10/1960 | Hamrick | 124/27 |
| 3,026,864 | 3/1962 | Gray | 124/27 |
| 3,166,321 | 1/1965 | Fleishman | 124/27 |
| 3,191,342 | 6/1965 | Chalmers | 124/16 |
| 3,254,640 | 6/1966 | Sprouse | 124/16 |
| 3,261,342 | 7/1966 | Harper et al. | 124/29 |
| 3,365,834 | 1/1968 | Kreft | 124/26 |
| 3,580,234 | 5/1971 | Guyer et al. | 124/21 |
| 3,709,495 | 1/1973 | Krombein | 124/26 |
| 3,774,585 | 11/1973 | Boyd | 124/21 |
| 3,897,061 | 7/1975 | Grattan | 124/26 |
| 3,949,731 | 4/1976 | Caso | 124/27 |
| 4,016,854 | 4/1977 | Lehman | 124/27 |
| 4,089,318 | 5/1978 | Hesener | 124/16 |
| 4,133,452 | 1/1979 | Wiltrout | 124/27 |
| 4,155,342 | 5/1979 | Traweek | 124/27 |
| 4,165,729 | 8/1979 | Niemirow | 124/17 |
| 4,541,402 | 9/1985 | Winters | 124/27 |
| 4,565,183 | 1/1986 | Smith | 124/26 |
| 4,665,885 | 5/1987 | Glomski et al. | 124/27 |
| 5,033,446 | 7/1991 | Bradt | 124/26 |
| 5,156,137 | 10/1992 | Clayton | 124/27 |
| 5,447,144 | 9/1995 | Ivy | 124/26 |
| 5,664,551 | 9/1997 | Spector | 124/16 |
| 5,678,528 | 10/1997 | Hadley | 124/25 |

FOREIGN PATENT DOCUMENTS

| | | | |
|---|---|---|---|
| 137075 | 5/1950 | Australia | 124/37 |
| 542950 | 12/1955 | Belgium | 124/16 |
| 493725 | 6/1953 | Canada | 124/16 |
| 21981 | 3/1917 | Denmark | 124/26 |
| 389298 | 9/1908 | France | 124/16 |
| 712592 | 10/1931 | France | 124/26 |
| 813092 | 5/1937 | France | 124/26 |
| 1095448 | 6/1955 | France | 124/27 |
| 606642 | 11/1934 | Germany | 124/16 |
| 666378 | 9/1938 | Germany | 124/26 |
| 1246471 | 8/1967 | Germany | 124/37 |
| 4960 | of 1824 | United Kingdom | 124/16 |

*Primary Examiner*—Michael J. Carone
*Assistant Examiner*—Fredrick T. French, III
*Attorney, Agent, or Firm*—Dunlap, Codding & Rogers, P.C.

[57] ABSTRACT

An intrusion apparatus for safely propelling a non-lethal diversionary device into a structure through a barrier. The intrusion apparatus comprises an extension device adapted to be gripped by an individual and being movable generally towards the barrier by the individual. A support assembly is connected to the extension device. The support assembly serves to support the non-lethal diversionary device as the extension device is moved towards the barrier. A barrier breaking assembly is also supported by the extension device. The barrier breaking assembly forms an opening sized to receive the non-lethal diversionary device through the barrier as the extension device is being moved towards the barrier. A propelling assembly is also supported by the extension device. The propelling assembly serves to selectively propel the non-lethal diversionary device into the structure through the opening formed in the barrier at a non-lethal velocity.

19 Claims, 5 Drawing Sheets

INTRUSION APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Existing grenade launchers have the ability to launch a non-lethal diversionary device, such as a tear gas, smoke, concussion or flash grenade, through windows or walls and into buildings. Due to the great velocity that the grenade launchers propel the non-lethal diversionary devices into the building, the non-lethal diversionary devices are capable of causing serious injury, including death, to those people occupying the building from impact with the non-lethal diversionary device.

Because of the serious threat to human life caused by the propelling of non-lethal diversionary devices into buildings with grenade launchers, law enforcement personnel typically use 2–3 people to manually deliver non-lethal diversionary devices through windows and into buildings to distract the people occupying the building such that law enforcement personnel can safely enter the building and apprehend the people occupying the building. One or two members of the law enforcement personnel will normally use a crow bar to break the screen/window and, if necessary, pull a curtain or Venetian blind aside. Another member will throw the non-lethal diversionary device into the room by hand. Because the law enforcement personnel are exposed to rifle and/or pistol fire from the building during the insertion of the non-lethal diversionary device into the building, other team members cover the operation with a variety of weapons to protect the law enforcement personnel from fire originating from the building.

Because of the inherent danger to people occupying the building from use of the grenade launcher, and the inherent danger to law enforcement personnel from manually delivering a non-lethal diversionary device into the building, a need exists for an apparatus capable of safely delivering the non-lethal diversionary device into a structure, such as a building without risk of serious injury to those people occupying the structure from impact with the non-lethal diversionary device while also permitting law enforcement personnel to remain safely out of the line of sight of at least one person occupying the structure when the non-lethal diversionary device is propelled into the structure. It is to such an improved apparatus for safely delivering non-lethal diversionary devices through barriers, such as a window, and into structures, such as a building, which the present invention is directed.

BRIEF SUMMARY OF THE INVENTION

Broadly, the present invention is an intrusion apparatus for safely propelling a non-lethal diversionary device, such as a tear gas, smoke, concussion or flash grenade, into a structure, through a barrier. The intrusion apparatus is provided with an extension device adapted to be gripped by an individual and being movable generally towards the barrier by the individual. Support means supported by the extension device are provided for supporting the non-lethal diversionary device as the extension device is moved towards the barrier. Forming means supported by the extension device are also provided. The forming means serves to form an opening sized to receive the non-lethal diversionary device through the barrier as the extension device is being moved towards the barrier. Finally, propelling means supported by the extension device are provided. The propelling means selectively propels the non-lethal diversionary device into the structure through the opening formed in the barrier at a non-lethal velocity.

One advantage of the intrusion apparatus constructed in accordance with the present invention is that a single individual can safely insert the non-lethal diversionary device through the barrier and into the structure because the support means, forming means and propelling means are all supported by the extension device. In use, the individual grips the extension device and then swings the intrusion apparatus towards the barrier so that the forming means breakingly engages at least a portion of the barrier while the individual remains safely out of the line of sight of at least one person occupying the structure when the opening in the barrier is formed. The individual then actuates the propelling means for discharging the non-lethal diversionary device through the opening formed in the barrier at a non-lethal velocity whereby the non-lethal diversionary device is safely propelled into the structure.

Other features and advantages of the intrusion apparatus constructed in accordance with the present invention will become apparent to those of at least ordinary skill in the art when the following description is read in light of the attached drawings and appended claims.

DETAILED DESCRIPTION OF THE INVENTION

Figure 1:
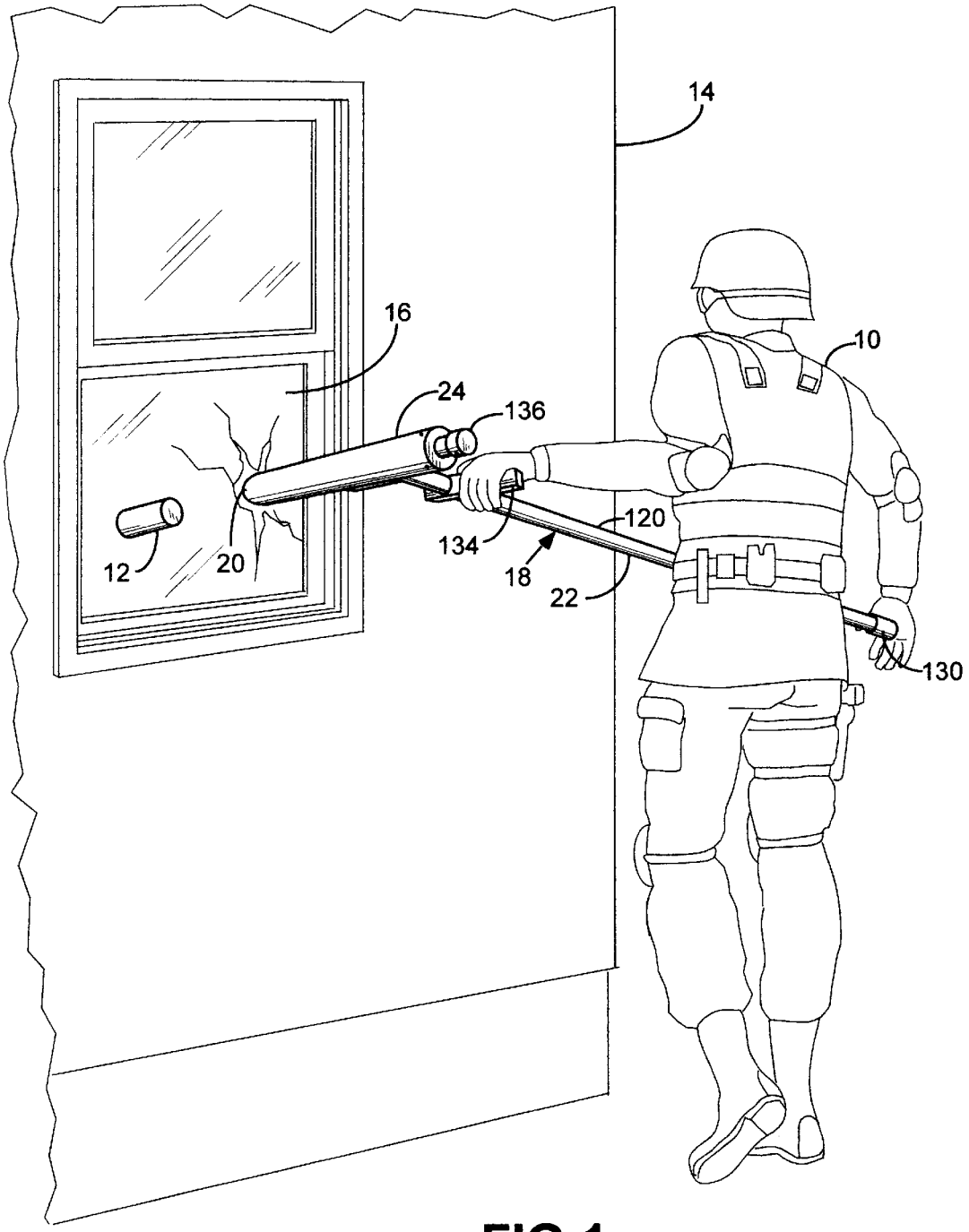
FIG. 1 is a perspective view illustrating an individual delivering a non-lethal diversionary device into a structure through a barrier with an intrusion apparatus constructed in accordance with the present invention.

Referring now to the drawings, and more particularly to FIG. 1, shown therein is a perspective view illustrating an individual 10 delivering a non-lethal diversionary device 12 into a structure 14 through a barrier 16 with an intrusion apparatus 18 constructed in accordance with the present invention. The structure 14 can be a building, automobile, airplane, bus, motorhome, phone booth or any other structure which can be occupied by at least one person. The barrier 16 can be a window, thin wall, door, screen, glass, mini-blinds, shutters, or draperies, for example.

In general, the intrusion apparatus 18 is constructed to support the non-lethal diversionary device 12 as the intrusion apparatus 18 is moved towards the barrier 16, to form an opening 20 sized to receive the non-lethal diversionary device 12 through the barrier 16 as the intrusion apparatus is being moved towards the barrier 16, and to selectively propel the non-lethal diversionary device 12 into the structure 14 through the opening 20 at a non-lethal velocity while also permitting the individual 10, who is operating the intrusion apparatus 18, to remain safely out of the line of sight of at least one person occupying the structure 14 when the non-lethal diversionary device 12 is propelled through the barrier 16 and into the structure 14.

The advantage of propelling the non-lethal diversionary device 12 into the structure 14 through the barrier 16 at a non-lethal velocity is to minimize the risk of serious injury to those person or persons occupying the structure 14 from impact with the non-lethal diversionary device 12. In one embodiment, the non-lethal velocity will not exceed about twenty-two feet per second (fifteen mph). In general, the non-lethal velocity should be a low enough velocity whereby the non-lethal diversionary device 12 will not become a lethal projectile. In one embodiment, the non-lethal diversionary device 12 will be propelled not more than about 100 feet, and desirably will be propelled about fifteen feet.

Unless otherwise set forth herein, each of the components of the intrusion apparatus 18 is constructed of rigid materials, such as aluminum, stainless steel or a composite material.

The non-lethal diversionary device 12 can be any type of device capable of distracting at least one person occupying the structure 14 such that law enforcement personnel can enter the structure 14 and safely apprehend the person occupying the structure 14, or that flushes the person occupying the structure 14 out of the structure 14, or non-lethally incapacitates the person occupying the structure 14. For example, the non-lethal diversionary device 12 can be a conventional tear gas, smoke, concussion, flash or pepper-spray grenade.

Figure 2:
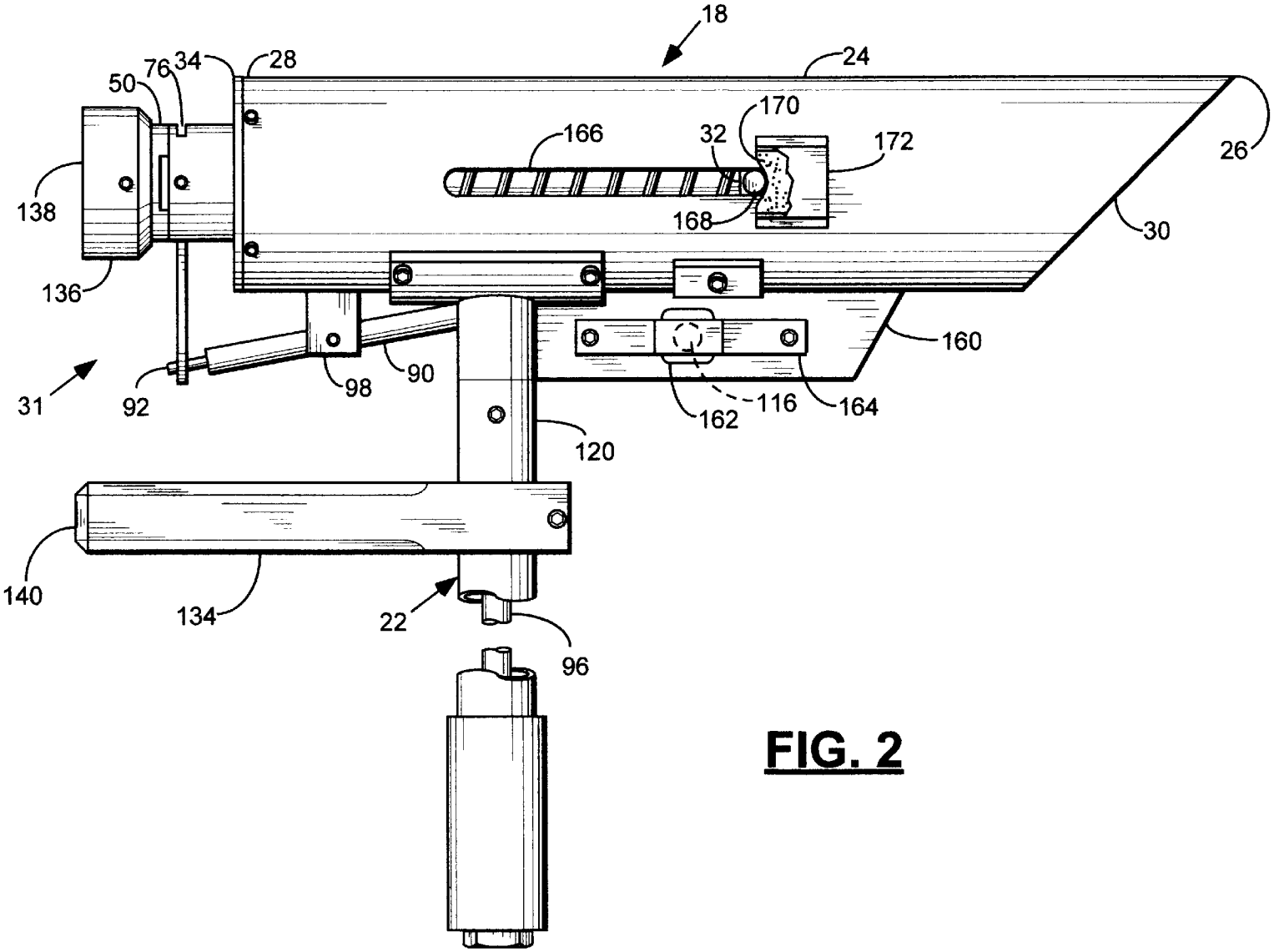
FIG. 2 is a side elevational, partially broken away view of the intrusion apparatus depicted in FIG. 1.
Figure 3:
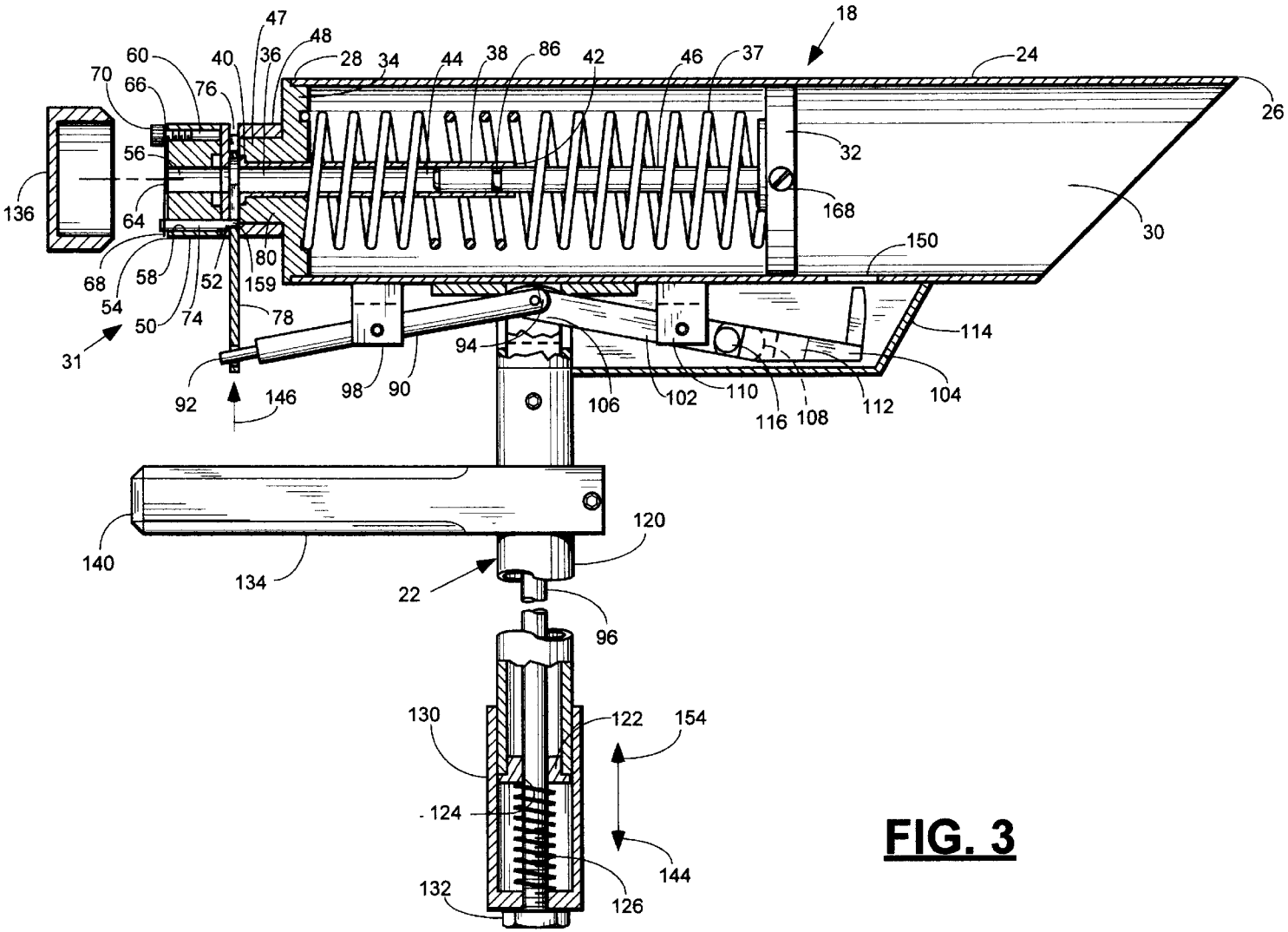
FIG. 3 is a side-elevational, partial cross-section view of the intrusion apparatus depicted in FIG. 2 wherein the intrusion apparatus is shown in an uncocked condition.

Referring now to FIGS. 2 and 3, one embodiment of the intrusion apparatus 18 constructed in accordance with the present invention will now be described. The intrusion apparatus 18 includes an elongated extension device 22 and a tube 24, which is connected to the extension device 22. The extension device 22 has a length desirably of about three feet to about five feet when the intrusion apparatus 18 is being utilized for discharging the non-lethal diversionary device 12 into a first floor window, and desirably of about twelve feet to about fifteen feet for discharging the non-lethal diversionary device 12 into a second floor window.

Figure 4:
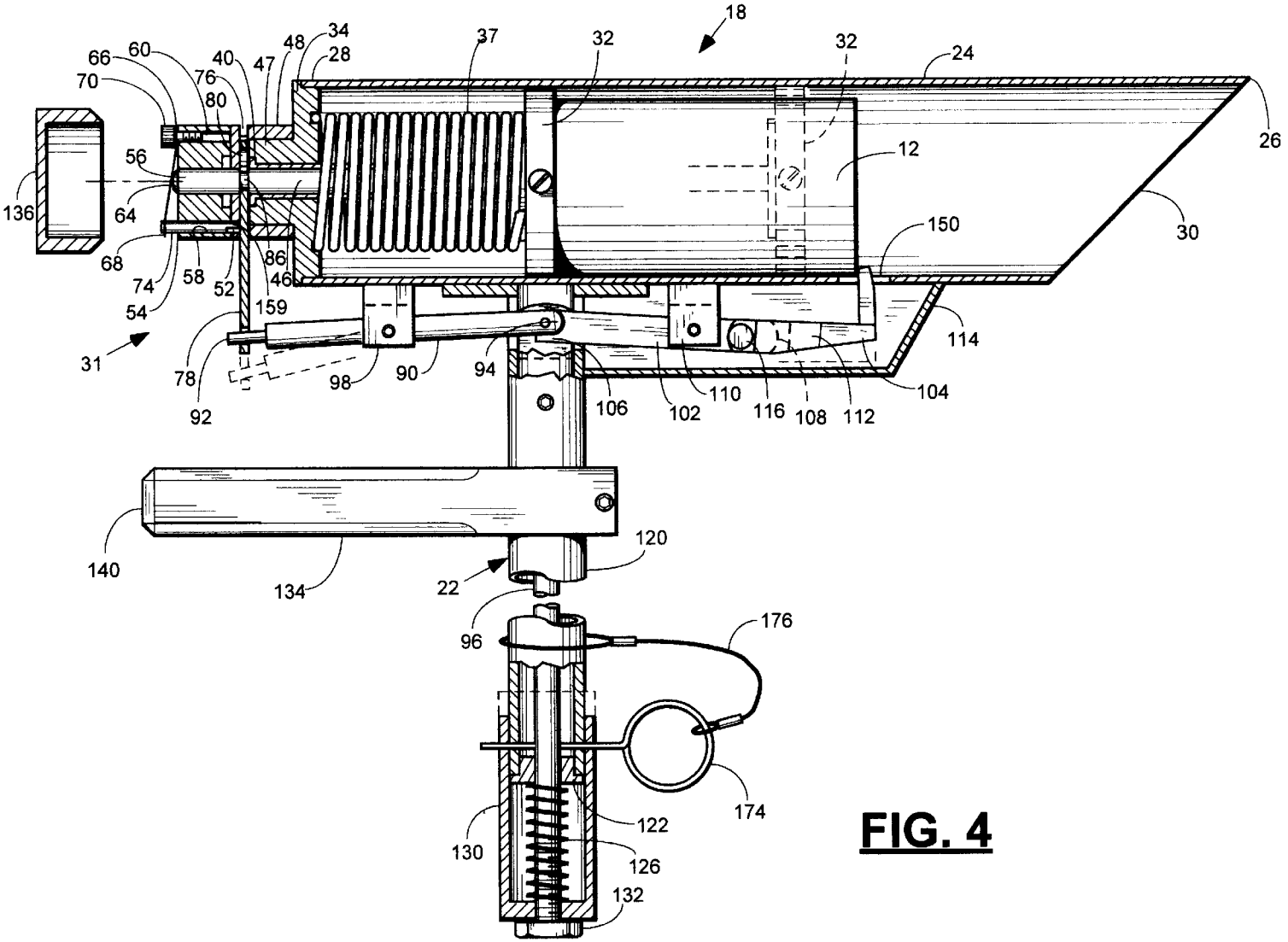
FIG. 4 is a side-elevational, partial cross-section view of the intrusion apparatus depicted in FIG. 2 wherein the intrusion apparatus is shown in a cocked condition.

The tube 24 has a first end 26 and a second end 28. The first end 26 of the tube 24 is formed into a shape which facilitates the insertion of the first end 26 through the barrier 16 in one continuous motion. As shown in FIGS. 2–4, the first end 26 can be formed into the shape of a syringe. The tube 24 extends angularly from the extension device 22 such that the first end 26 of the tube 24 can be forced through the barrier 16 without the individual 10, who is gripping the extension device 22, being in the line of sight of at least one person occupying the structure 14. Desirably, the tube 24 extends at an angle of between about 45 degrees to about 135 degrees from the extension device 22, and more desirably, the tube 24 extends at an angle of about 90 degrees from the extension device 22.

The tube 24 also includes a bore 30 extending generally between the first end 26 and the second end 28 thereof. The bore 30 is sized and adapted to receive the non-lethal diversionary device 12 therein such that the non-lethal diversionary device 12 is supported during operation of the intrusion apparatus 18. In one preferred embodiment, the tube 24 serves as a support assembly for supporting the non-lethal diversionary device, and as a forming assembly for forming the opening 20.

The intrusion apparatus 18 includes a propelling assembly 31, which is discussed hereinafter. The propelling assembly 31 includes a moveable plate 32 is disposed in the bore 30 of the tube 24 such that the moveable plate 32 can freely reciprocate in the bore 30 from an uncocked position (as shown in FIG. 3) to a cocked position (as shown in FIG. 4). A cap member 34 is connected to the second end 28 of the tube 24. The cap member 34 is provided with an aperture 36 (FIG. 3) formed therethrough. A propulsion spring 37 is provided in between the cap member 34 and the moveable plate 32. As will be described in more detail hereinafter, the propulsion spring 37 is sized and adapted to propel or lob the non-lethal diversionary device 12 out of the bore 30 of the tube 24 at the non-lethal velocity whereby at least one person occupying the structure 14 will not be seriously injured from impact with the non-lethal diversionary device 12.

A rod guide 38 is disposed through the aperture 36 formed in the cap member 34 such that the rod guide 38 extends past the cap member 34 a predetermined distance into the bore 30 of the tube 24. The rod guide 38 has a first end 40, a second end 42 and a rod receiving bore 44 extending generally therebetween. The rod receiving bore 44 is sized and adapted to receive a rod 46 therein such that the rod 46 can reciprocate in the rod receiving bore 44. The rod 46 is connected to the plate 32. As will be described in more detail hereinafter, the rod guide 38 serves to guide and/or maintain the plate 32 in a fixed angular relationship with respect to the tube 24 as the plate 32 is moved between the uncocked position and the cocked position.

The cap member 34 is provided with a substantially cylindrically-shaped first portion 47 having a reduced diameter as compared to the remainder of the cap member 34. A sleeve 48 is matingly disposed on the first portion 47 of the cap member 34, and is secured thereon via any suitable means, such as a screw (not shown).

The intrusion apparatus 18 is further provided with a housing member 50. The housing member 50 is provided with a first end 52, a second end 54, a first aperture 56, a second aperture 58 and a third aperture 60. The first end 52 of the housing member 50 is connected to the sleeve 48 via screws (not shown), for example. The first aperture 56 and the second aperture 58 of the housing member 50 extend generally between the first end 52 and the second end 54 thereof. The third aperture 60 extends through the second end 54 of the housing member 50 towards the first end 52 thereof, and is threaded for a purpose to be described hereinafter. The first aperture 56 is sized to receive the rod 46 and is generally aligned with the aperture 36 formed in the cap member 34 such that the rod 46 is capable of simultaneously reciprocating in both the first aperture 56 formed in the housing member 50 and the aperture 36 formed in the cap member 34.

A spring arm 64 is disposed on the second end 54 of the housing member 50 such that the spring arm 64 covers at least a portion of the first, second and third apertures 56, 58 and 60. The spring arm 64 has a first end 66 and a second end 68. The spring arm 64 is secured to the housing member 50 via a bolt 70 disposed through the spring arm 64 near the first end 66 thereof, and inserted into the threaded third aperture 60.

A pin 74 is carried on the second end 68 of the spring arm 64. The pin 74 is disposed in the second aperture 58 formed in the housing member 50 such that the pin 74 can freely reciprocate therein.

A flange receiving slot 76 is formed in between the mating faces of the cap member 34 and the housing member 50. The flange receiving slot 76 is sized and adapted to receive a flange 78 such that the flange 78 can freely reciprocate in the flange receiving slot 76.

It should be noted that in the uncocked position of the plate 32 (as shown in FIG. 3), the pin 74 extends a distance into the flange receiving slot 76. However, when the plate 32 is moved to the cocked position, the rod 46 is extended through the aperture 36 in the cap member 34, and through the first aperture 56 in the housing member 50 so as to engage the spring arm 64 and to move the pin 74 into a retracted position (as shown in FIG. 4) wherein the pin 74 does not extend into the flange receiving slot 76.

Figure 5:
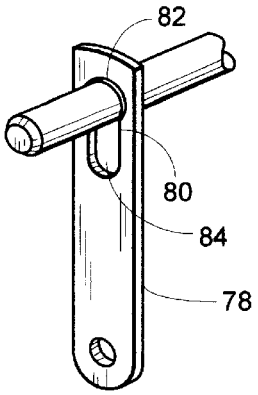
FIG. 5 is a perspective view illustrating a rod positioned in an enlarged first portion of an elongated slot formed in a flange.
Figure 6:
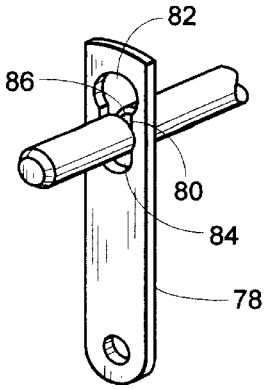
FIG. 6 is a perspective view illustrating the rod depicted in FIG. 5 positioned in a reduced second portion of the elongated slot formed in the flange.
Figure 7:
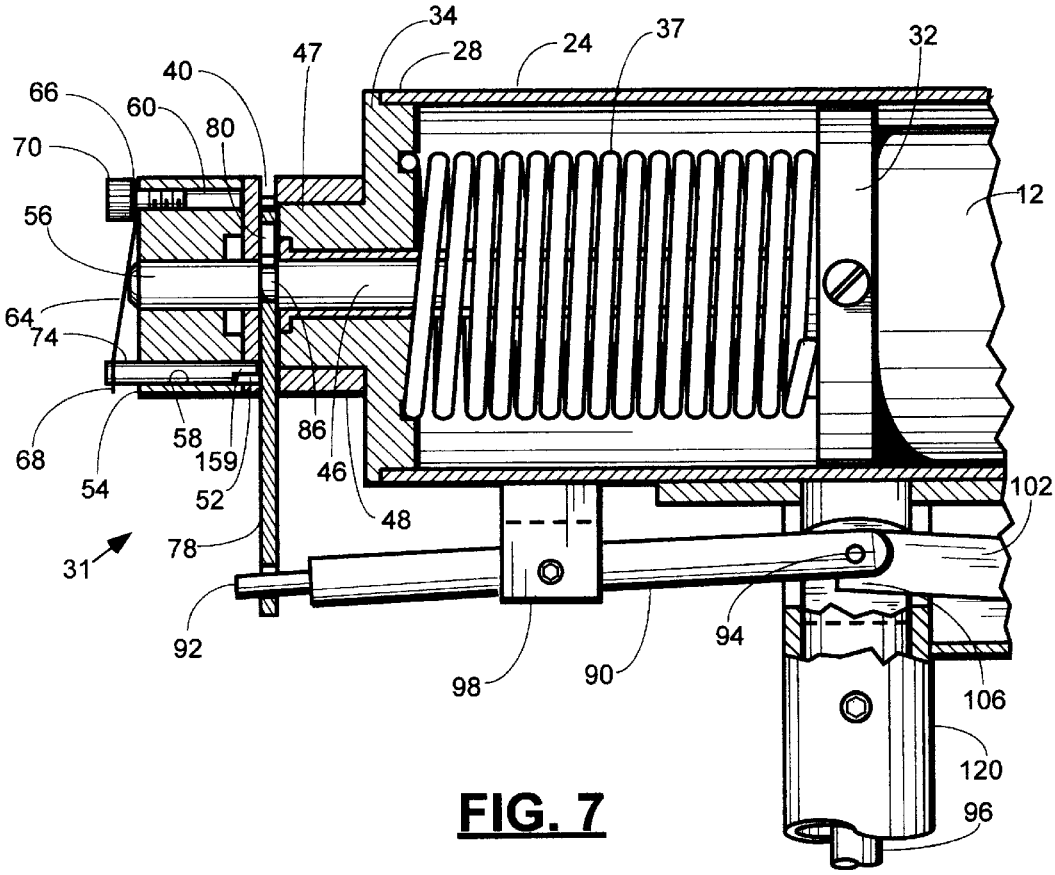
FIG. 7 is a fragmental, cross-sectional view of the intrusion apparatus depicted in FIG. 4.

As shown in FIGS. 5 and 6, the flange 78 is provided with an elongated, key-shaped slot 80. The slot 80 has an enlarged first portion 82 and a reduced second portion 84. The enlarged first portion 82 of the slot 80 is sized and adapted to receive the rod 46 therethrough while the reduced second portion 84 of the slot 80 is sized to not pass the rod 46 therethrough. In the uncocked position of the plate 32 (as shown in FIGS. 3 and 5), the first portion 82 of the slot 80 is aligned with the aperture 36 in the cap member 34 and the first aperture 56 in the housing member 50 to permit the rod 46 to pass through the aperture 36, the enlarged first portion 82 and the first aperture 56.

However, in the cocked position of the plate 32 (as shown in FIGS. 4 and 6), the flange 78 is aligned with an annular groove 86 formed in the rod 46 to permit the flange 78 to move upwardly from an uncocked position into a cocked position wherein the flange 78 is disposed in the annular groove 86 formed in the rod 46. It should be noted that when the flange 78 is disposed in the annular groove 86 formed in the rod 46 (the cocked position), the flange 78 prevents movement along the axial length of the rod 46 and thereby maintains the rod 46 and the plate 32 in the cocked position.

To move the flange 78 between the uncocked position and the cocked position, the intrusion apparatus 18 is provided with a first lever arm 90. The first lever arm 90 has a first end 92 and a second end 94. The first end 92 of the first lever arm 90 is pivotally connected to the flange 78. The second end 94 of the first lever arm 90 is pivotally attached to a trigger rod 96 for a purpose to be described hereinafter. The first lever arm 90 is also pivotally attached to the tube 24 via a first support member 98.

To maintain the non-lethal diversionary device 12 inside the tube 24 when the plate 32 is disposed in the cocked position, the intrusion apparatus 18 is provided with a second lever arm 102 and a substantially L-shaped bracket 104. The second lever arm 102 has a first end 106 and a second end 108. The first end 106 of the second lever arm 102 is pivotally attached to the trigger rod 96 and the second end 108 of the second lever arm 102 is pivotally attached to the L-shaped bracket 104. The second lever arm 102 is also pivotally attached to the tube 24 via a second support member 110.

The L-shaped bracket 104 includes a first leg 112 and a second leg 114. To selectively maintain the second lever arm 102 and the first leg 112 of the L-shaped bracket 104 in an aligned position (as shown in FIG. 3), the first leg 112 of the L-shaped bracket 104 carries a spring-loaded pin 116 adapted to be selectively disposed in an aperture (not shown) formed in the second lever arm 102.

The intrusion apparatus 18 is further provided with an elongated sleeve 120 having a stop plate 122 disposed therein. The stop plate 122 has an opening 124 formed therethrough. The trigger rod 96 of the extension device 22 is disposed through the elongated sleeve 120 and the opening 124 formed in the stop plate 122 such that a portion of the trigger rod 96 extends past the stop plate 122.

A trigger spring 126 is disposed on the portion of the trigger rod 96 extending past the stop plate 122. The portion of the trigger rod 96 extending past the stop plate 122 is disposed through a substantially conically shaped trigger member 130 overlying the sleeve 120. The substantially conically shaped trigger member 130 is maintained on the trigger rod 96 by a nut 132 threaded onto the end of the trigger rod 96.

The trigger member 130 is selectively movable between an uncocked position (as shown in FIG. 3) and a cocked position (as shown in FIG. 4). In the uncocked position, the trigger member 130 is moved upwardly onto the sleeve 120 (with respect to the position of the trigger member 130 in the cocked position) to compress the trigger spring 126 between the stop plate 122 and the trigger member 130. The trigger member 130 is maintained in the uncocked position against the force of the trigger spring 126 by the pin 74 engaging the flange 78.

The intrusion apparatus 18 may also be provided with a handle grip 134, if desired. The handle grip 134 is connected to the sleeve 120 of the extension device 22 so as to permit the position of the handle grip 134 to be adjusted longitudinally on the extension device 22 while also permitting the position of the handle grip 134 to be secured. The handle grip 134 is sized and adapted to be gripped by the individual 10 with one hand (as shown in FIG. 1). The handle grip 134 is positioned on the sleeve 120 to permit the individual 10 (who is also gripping the trigger member 130 with the other hand) to swing or move the intrusion apparatus 18 through the barrier 16 in one continuous motion without the individual 10 being in the line of sight of the person occupying the structure 14.

A guard cap 136 is disposed on the housing member 50 to protect the spring arm 64 and the pin 74 (the guard cap 136 is shown in FIGS. 3 and 4 as being removed from the housing member 50 for purposes of clarity). As best shown in FIG. 2, the guard cap 136 is provided with an end 138, and the handle grip 134 is provided with an end 140. The end 138 of the guard cap 136 and the end 140 of the handle grip 134 are disposed in a substantially coplanar relationship to provide a level platform for the intrusion apparatus 18 to facilitate the cocking of the intrusion apparatus 18.

When the intrusion apparatus 18 is being disposed in a cocked condition (as shown in FIG. 4) from an uncocked condition (as shown in FIG. 3), the intrusion apparatus 18 is disposed on the level platform provided by the ends 138 and 140 of the guard cap 136 and the handle grip 134, respectively. Then, force is applied to the plate 32 by a plunger (not shown) to move the plate 32 from the uncocked position to the cocked position against the force of the propulsion spring 37. While the plate 32 is being moved from the uncocked position to the cocked position, the rod 46 (which is connected to the plate 32) passes through the aperture 36 in the cap member 34, the enlarged first portion 82 of the slot 80 in the flange 78 and the first aperture 56 in the housing member 50 until the rod 46 engages the spring arm 64. The continued motion of the plate 32 after the rod 46 engages the spring arm 64 moves the spring arm 64 and thereby the pin 74 to the cocked position wherein the pin 74 is retracted out of the flange receiving slot 76 and the flange 78 is aligned with the annular groove 86 formed in the rod 46. Once the pin 74 is retracted out of the flange receiving slot 76 and the flange 78 is aligned with the annular groove 86 formed in the rod 46, the flange 78 is caused to move upwardly from the uncocked position into the cocked position wherein the flange 78 is disposed in the annular groove 86 formed in the rod 46 by the force of the trigger spring 126.

That is, the trigger spring 126, which is under compression in the uncocked position, moves the trigger rod 96 in a direction 144 generally away from the tube 24. The movement of the trigger rod 96 causes the first and second lever arms 90 and 102 to simultaneously pivot. The pivotation of the first lever arm 90 moves the flange 78 in a direction 146 into the flange receiving slot 76 so that the portion of the flange 78 adjacent to the reduced second portion 84 of the slot 80 will be disposed in the annular groove 86 formed in the rod 46 to prevent movement along the axial length of the rod 46 and to thereby maintain the rod 46 and the plate 32 in the cocked position. The pivotation of the second lever arm 102 causes the second leg 114 of the L-shaped bracket 104 to move through an opening 150 formed in the tube 24 and into the bore 30. Once the second leg 114 of the L-shaped bracket 104 is moved into the bore 30, the second leg 114 engages the non-lethal diversionary device 12 and prevents the removal of the non-lethal diversionary device 12 from the bore 30 of the tube 24.

Once the intrusion apparatus 18 is disposed in the cocked position with the non-lethal diversionary device 12 loaded into the bore 30 of the tube 24, the non-lethal diversionary device 12 can be selectively propelled or lobbed from the tube 24 by moving the trigger member 130 and thus, the trigger rod 96, in a direction 154 generally toward the tube 24. The movement of the trigger rod 96 in the direction 154 causes the first and second lever arms 90 and 102 to pivot simultaneously. The pivotation of the first lever arm 90 causes the flange 78 to move out of the flange receiving slot 76. The flange 78 is moved until the enlarged first portion 82 of the slot 80 formed in the flange 78 is aligned with the aperture 36 formed in the cap member 34. Once the enlarged first portion 82 of the slot 80 is aligned with the aperture 36, the rod 46 is released and the compressed propulsion spring 37 moves the plate 32 from the cocked position to the uncocked position thereby propelling or lobbing the non-lethal diversionary device 12 from the tube 24.

The releasing of the rod 46 causes the spring arm 64 to move the pin 74 to the uncocked position wherein an end 159 of the pin 74 extends into the flange receiving slot 76 and the slot 80 formed in the flange 78 so that the end 159 of the pin 74 engages the flange 78 (as shown in FIG. 3) and to thereby maintain the trigger member 130 in the uncocked position against the force of the trigger spring 126 as previously discussed.

Referring again to FIG. 2, for purposes of safety, the intrusion apparatus 18 is provided with a guard 160 overlying the second lever arm 102 and the L-shaped bracket 104. The guard 160 is connected to the tube 24 via any suitable means, such as screws, for example. The guard 160 is provided with an opening 162 provided therethrough. The opening 162 is sized and adapted to receive at least a portion of the spring loaded pin 116 and to permit the spring loaded pin 116 to reciprocate vertically therein. This permits the second leg 114 of the L-shaped bracket 104 to be selectively moved out of the tube 24 when the intrusion apparatus 18 is disposed in the cocked condition to permit the non-lethal diversionary device 12 to be unloaded from the tube 24.

To protect the spring loaded pin 116 and to prevent damage to and/or the inadvertent movement of the spring loaded pin 116, a U-shaped pin guard 164 is provided. The U-shaped pin guard 164 is connected to the guard 160 via screws, for example, and is positioned to overlie the spring loaded pin 116.

To guide the plate 32 during movement of the plate 32 between the uncocked position and the cocked position, a pair of opposing guide slots 166 are provided in the tube 24 (only one of the guide slots 166 is shown in the drawings for purposes of clarity). A pair of opposing guide members 168 are connected to the plate 32 and disposed in respective guide slots 166 to guide and stabilize the plate 32 during movement of the plate 32 between the uncocked position and the cocked position.

To stop the movement of the plate 32 when the plate 32 is being moved by the propulsion spring 37 from the cocked position to the uncocked position, a stop member 170 is provided on the tube 24 adjacent to each of the guide slots 166 to engage the guide members 168. The stop members 170 can be constructed of a resilient material, such as rubber, to cushion the respective guide members 168 when the guide members 168 impact the stop members 170. The stop members 170 are maintained on the tube 24 by respective guards 172.

To prevent the inadvertent firing of the intrusion apparatus 18, a safety pin 174 is provided.

The safety pin 174 is secured to the handle assembly 22 by a wire cable 176. As shown in FIG. 4, the safety pin 174 is disposed through aligning apertures formed through the trigger member 130, the sleeve 120 and the trigger rod 96 to maintain same in a stable condition.

In use, the intrusion apparatus 18 is loaded with the non-lethal diversionary device 12 by first disposing the intrusion apparatus 18 on the level platform provided by the ends 138 and 140 of the guard cap 136 and the handle grip 134, respectively. The non-lethal diversionary device 12 is then disposed into the tube 24 such that the non-lethal diversionary device 12 rests against the plate 32. Force is then applied to the non-lethal diversionary device 12 to move the plate 32 from the uncocked position to the cocked position, as previously discussed. Once the plate 32 is disposed in the cocked position, the second leg 114 of the L-shaped bracket 104 is disposed in the bore 30 of the tube 24 to maintain the non-lethal diversionary device 12 within the tube 24. The individual 10 then inserts the safety pin 174 through the aligned apertures.

As shown in FIG. 1, the individual 10 grips the trigger member 130 and the handle grip 134 of the cocked intrusion apparatus 18. The individual 10 then swings the intrusion apparatus 18 towards the barrier 16 so that the first end 26 of the tube 24 breakingly engages at least a portion of the barrier 16 to form the opening 20 through the barrier 16 whereby the first end 26 of the tube 24 is disposed inside the structure 14. The individual 10 then removes the safety pin 174 and then moves the trigger member 130 from the cocked position to the uncocked position whereupon the non-lethal diversionary device 12 is discharged from the tube 24 and into the structure 14 as previously discussed.

Although the intrusion apparatus 18 has been shown and described as having the propulsion spring 37 for ejecting the non-lethal diversionary device 12 out of the tube 24, it should be understood that other means for ejecting the non-lethal diversionary device 12 out of the tube 24 are also contemplated. For example, a pneumatic device, or an elastic bungee cord could be utilized in place of the propulsion spring 37 to eject the non-lethal diversionary device 12 out of the tube 24.

Although the intrusion apparatus 18 has been shown and described as being utilized to deliver the non-lethal diversionary device 12 into the structure 14 through the barrier 16, it should also be noted that the intrusion apparatus 18 could also be utilized to selectively deliver the non-lethal diversionary device 12 into the structure 14 without going through the barrier 14. For example, the first end 26 of the tube 24 could be inserted through an open window or around a corner. In this position, the trigger member 130 could then be moved to deliver the non-lethal diversionary device 12 out of the tube 24.

Changes may be made in the combinations, operations, and arrangements of the various parts and elements described herein without departing from the spirit and the scope of the invention as defined in the following claims.

What is claimed is:

1. An intrusion apparatus for propelling a non-lethal diversionary device into a structure through a barrier, comprising:

an extension device adapted to be gripped by an individual, the extension device being swingable generally towards the barrier by the individual, the extension device having a length and being elongated along the length, the extension device including a trigger rod extending through the extension device along at least a portion of the length thereof;

a support assembly supported by the extension device for supporting the non-lethal diversionary device as the extension device is moved relative to the barrier;

a forming assembly supported by the extension device, the forming assembly being sized and shaped for breakingly engaging the barrier and thereby forming an opening through the barrier sized to receive the non-lethal diversionary device when the individual grips the extension device and swings the forming assembly into the barrier, the forming assembly being positioned on the extension device whereby the individual swinging the extension device is spaced a distance from the opening formed by the forming assembly; and a propelling assembly supported by the extension device and operably connected to the trigger rod for propelling the non-lethal diversionary device into the structure through the opening formed in the barrier at a non-lethal velocity and wherein the propelling assembly comprises:

a trigger member disposed a distance from the forming assembly and movably supported by the extension device whereby the trigger member can be moved by the individual while the individual is spaced a distance from the opening formable through the barrier when the individual grips the extension device and swings the forming assembly into the barrier the trigger member operably connected to the trigger rod for moving the trigger rod to actuate the propelling assembly.

2. An intrusion apparatus as defined in claim 1, wherein the support assembly includes:

a tube connected to the extension device, the tube defining a bore sized to receive the non-lethal diversionary device.

3. An intrusion apparatus as defined in claim 2, wherein the extension device has a first end and a second end and the tube is connected to the first end of the extension device and at least a portion of the propelling assembly is disposed within the bore of the tube and positioned to selectively propel the non-lethal diversionary device from the bore of the tube, and wherein the intrusion apparatus further comprises a trigger member disposed on the extension device whereupon movement of the trigger member relative to the extension device causes the propelling assembly to propel the non-lethal diversionary device from the bore of the tube.

4. An intrusion apparatus as defined in claim 2, wherein the tube has an opening formed therethrough, and wherein the intrusion apparatus further comprises a bracket having a portion selectively disposable through the opening formed in the tube to maintain the non-lethal diversionary device within the bore of the tube.

5. An intrusion apparatus as defined in claim 2, wherein the propelling assembly includes:

a plate disposed in the bore of the tube such that the plate can freely reciprocate in the bore from an uncocked position to a cocked position;

a rod connected to the plate and extending a distance therefrom;

a cap member connected to an end of the tube, the cap member having an aperture formed therethrough with the rod being disposed through the aperture when the plate is disposed in the cocked position;

means for selectively moving the plate from the cocked position to the uncocked position to propel the non-lethal diversionary device from the tube; and means engaging at least a portion of the rod to maintain the plate in the cocked position.

6. An intrusion apparatus in combination with a non-lethal diversionary device for propelling the non-lethal diversionary device into a structure so as to non-lethally incapacitate a person occupying the structure, the intrusion apparatus comprising:

an extension device adapted to be gripped by an individual, the extension device including a trigger rod extending through the extension device along at least a portion of the length thereof;

a support assembly supported by the extension device for supporting the non-lethal diversionary device; and a propelling assembly supported by the extension device and operably connected to the trigger rod for selectively propelling the non-lethal diversionary device at a non-lethal velocity and wherein the propelling assembly comprises:

a trigger member disposed a distance from the support assembly and movably supported by the extension device, the trigger member operably connected to the trigger rod for moving the trigger rod to actuate the propelling assembly.

7. An intrusion apparatus as defined in claim 6, further comprising:

a tube connected to the extension device, the tube defining a bore sized to receive the non-lethal diversionary device.

8. An intrusion apparatus as defined in claim 7, wherein the extension device has a first end and a second end and the tube is connected to the first end of the extension device and at least a portion of the propelling means is disposed within the bore of the tube and positioned to selectively propel the non-lethal diversionary device from the bore of the tube, and wherein the intrusion apparatus further comprises a trigger member disposed on the extension device whereupon movement of the trigger member relative to the extension device causes the propelling means to propel the non-lethal diversionary device from the bore of the tube.

9. An intrusion apparatus as defined in claim 7, wherein the tube has an opening formed therethrough, and wherein the intrusion apparatus further comprises a bracket having a portion selectively disposable through the opening formed in the tube to maintain the non-lethal diversionary device within the bore of the tube.

10. An intrusion apparatus as defined in claim 7, wherein the propelling assembly includes:

a plate disposed in the bore of the tube such that the plate can freely reciprocate in the bore from an uncocked position to a cocked position;

a rod connected to the plate and extending a distance therefrom;

a cap member connected to an end of the tube, the cap member having an aperture formed therethrough with the rod being disposed through the aperture when the plate is disposed in the cocked position;

means for selectively moving the plate from the cocked position to the uncocked position to propel the non-lethal diversionary device from the tube; and means engaging at least a portion of the rod to maintain the plate in the cocked position.

11. An intrusion apparatus as defined in claim 7, wherein the non-lethal diversionary device is selected from a group comprising a tear gas grenade, a smoke grenade, a concussion grenade, a flash grenade, and a pepper-spray grenade.

12. An intrusion apparatus for propelling a non-lethal diversionary device into a structure through a barrier, comprising:

an extension device adapted to be gripped by an individual and being movable generally towards the barrier by the individual, the extension device having a length in a range from about 3 feet to about 15 feet, the extension device including a trigger rod extending through the extension device along at least a portion of the length thereof;

a tube connected to the extension device, the tube having a first end sized and shaped to breakingly engage and thereby form an opening through the barrier such that the first end of the tube extends through the barrier, the tube extending angularly from the extension device such that the first end of the tube can be forced through the barrier without the individual being in the line of sight of at least one person occupying the structure, the tube including a bore extending through the first end of the tube, the bore being sized to receive the non-lethal diversionary device whereby the tube is capable of supporting the non-lethal diversionary device when the non-lethal diversionary device is disposed within the bore and the non-lethal diversionary device is capable of being selectively discharged from the bore when the first end of the tube has been forced through the barrier; and a propelling assembly supported by the extension device and operably connected to the trigger rod for selectively propelling the non-lethal diversionary device from the bore and into the structure through the first end of the tube at a non-lethal velocity and wherein the propelling assembly comprises:

a trigger member disposed a distance from the tube and movably supported by the extension device whereby the trigger member can be moved by the individual while the individual is spaced a distance from the opening formable through the barrier when the individual grips the extension device and swings the tube into the barrier, the trigger member operably connected to the trigger rod for moving the trigger rod to actuate the propelling assembly.

13. An intrusion apparatus as defined in claim 12, wherein the non-lethal diversionary device is selected from a group comprising a tear gas grenade, a smoke grenade, a concussion grenade, a flash grenade, and a pepper-spray grenade.

14. An intrusion apparatus as defined in claim 12, wherein the non-lethal diversionary device is selected from a group consisting of a tear gas grenade, a smoke grenade, a concussion grenade, a flash grenade, and a pepper-spray grenade.

15. A method for an individual to propel a non-lethal diversionary device into a structure through a barrier so as to incapacitate a person occupying the structure, the method comprising the steps of:

supporting the non-lethal diversionary device via a support assembly supported by an extension device having a length of at least about 3 feet;

gripping the extension device by the individual a distance from the support assembly;

swinging the extension device by the individual towards the barrier whereby a forming assembly supported by the extension device breakingly engages the barrier and thereby forms an opening sized to receive the non-lethal diversionary device through the barrier and whereby the non-lethal diversionary device is positioned adjacent to the opening; and propelling, at a non-lethal velocity, the non-lethal diversionary device from the extension device into the structure through the opening formed in the barrier.

16. The method of claim 15, wherein the non-lethal diversionary device is selected from a group comprising a tear gas grenade, a smoke grenade, a concussion grenade, a flash grenade, and a pepper-spray grenade.

17. A method for incapacitating a person occupying a structure, comprising the steps of:

providing a non-lethal diversionary device, the non-lethal diversionary device being selected from a group comprising a tear gas grenade, a smoke grenade, a concussion grenade, a flash grenade, and a pepper-spray grenade;

supporting the non-lethal diversionary device on one end of an extension device;

gripping another end of the extension device by the individual, the extension device having a length of at least about 3 feet;

swinging the first end of the extension device by the individual towards the barrier so as to breakingly engage the barrier and thereby form an opening sized to receive the non-lethal diversionary device through the barrier; and propelling, at a non-lethal velocity, the non-lethal diversionary device from the extension device into the structure through the opening formed in the barrier.

18. A method for propelling a non-lethal diversionary device into a structure through a barrier, comprising:

providing an intrusion apparatus comprising:

an extension device adapted to be gripped by an individual and being movable generally towards the barrier by the individual, the extension device having a length in a range from about 3 feet to about 15 feet;

a tube connected to the extension device, the tube having a first end shaped to breakingly engage and thereby form an opening through the barrier such that the first end of the tube extends through the barrier, the tube extending angularly from the extension device such that the first end of the tube can be forced through the barrier without the individual being in the line of sight of at least one person occupying the structure, the tube including a bore extending through the first end of the tube, the bore being sized to receive the non-lethal diversionary device whereby the tube is capable of supporting the non-lethal diversionary device when the non-lethal diversionary device is disposed within the bore and the non-lethal diversionary device is capable of being selectively discharged from the bore when the first end of the tube has been inserted through the barrier; and propelling means supported by the extension device for selectively propelling the non-lethal diversionary device from the bore and into the structure through the first end of the tube at a non-lethal velocity;

disposing the non-lethal diversionary device in the bore of the tube;

gripping the extension device by the individual a distance from the tube;

forcing, by the individual, the first end of the tube through the barrier so that the first end of the tube breakingly engages the barrier and the first end of the tube extends through the barrier whereby the non-lethal diversionary device can be propelled out of the bore and into the structure; and activating the propelling means whereby the non-lethal diversionary device is propelled from the bore and into the structure at the non-lethal velocity so as to incapacitate the person occupying the structure.

19. The method of claim 18, wherein the non-lethal diversionary device is selected from a group comprising a tear gas grenade, a smoke grenade, a concussion grenade, a flash grenade, and a pepper-spray grenade.

* * * * *

UNITED STATES PATENT AND TRADEMARK OFFICE

CERTIFICATE OF CORRECTION

PATENT NO. : 6,112,733
DATED : September 5, 2000
INVENTOR(S) : Donald W. Wooten et al.

It is certified that error appears in the above-identified patent and that said Letters Patent is hereby corrected as shown below:

Title page,
Item [56], References Cited, U.S. PATENT DOCUMENTS, add the following U.S. Patents:

| | | | |
|---|---|---|---|
| -- | 3,318,033 | 5/1967 | Barr |
| | 4,270,293 | 6/1981 | Plumer et al. |
| | 5,540,284 | 7/1996 | Esposito et al. |
| | 5,690,089 | 11/1997 | Ward -- |

FOREIGN PATENT DOCUMENTS, add the following foreign patents:

| | | |
|---|---|---|
| -- 402646 | 1909 | France |
| 29708251 | 11/1996 | Germany |
| 2321951 | 12/1998 | United Kingdom -- |

Column 2,
Line 40, delete “cross-section” and substitute -- cross-sectional -- therefor.
Line 43, delete “cross-section” and substitute -- cross-sectional -- therefor.

Column 4,
Line 10, delete “moveable plate 32 is” and substitute therefor -- movable plate 32 --.
Line 11, delete “moveable” and substitute -- movable -- therefor.
Line 17, delete “moveable” and substitute -- movable -- therefor.

Column 7,
Line 50, delete “and”.

Column 8,
Line 7, delete “are” and substitute -- is -- therefor.
Line 10, delete “are” and substitute -- is -- therefor.

UNITED STATES PATENT AND TRADEMARK OFFICE

CERTIFICATE OF CORRECTION

PATENT NO. : 6,112,733
DATED : September 5, 2000
INVENTOR(S) : Donald W. Wooten et al.

It is certified that error appears in the above-identified patent and that said Letters Patent is hereby corrected as shown below:

Column 9,
Line 52, delete “barrier” and substitute -- barrier, -- therefor.

Signed and Sealed this

Thirteenth Day of August, 2002

*Attest:*

*Attesting Officer*

JAMES E. ROGAN
*Director of the United States Patent and Trademark Office*